US010748366B2

(12) United States Patent
Pang et al.

(10) Patent No.: US 10,748,366 B2
(45) Date of Patent: Aug. 18, 2020

(54) MOBILE-BASED ACCESS CONTROL SYSTEM WITH WIRELESS ACCESS CONTROLLER

(71) Applicant: Timetec Holding Sdn Bhd, Bandar Kinrara (MY)

(72) Inventors: Kok Loong Pang, Bandar Kinrara (MY); Hon Seng Teh, Bandar Kinrara (MY)

(73) Assignee: Timetec Holding Sdn Bhd, Puchong (MY)

( * ) Notice: Subject to any disclaimer, the term of this patent is extended or adjusted under 35 U.S.C. 154(b) by 0 days.

(21) Appl. No.: 16/283,410

(22) Filed: Feb. 22, 2019

(65) Prior Publication Data

US 2019/0318559 A1 Oct. 17, 2019

(30) Foreign Application Priority Data

Apr. 13, 2018 (MY) ..... 2018701480

(51) Int. Cl.

| | |
|---|---|
| ***G07C 9/00*** | (2020.01) |
| ***G07C 9/28*** | (2020.01) |
| ***G07C 9/27*** | (2020.01) |
| ***G07C 9/25*** | (2020.01) |
| *G07C 9/26* | (2020.01) |

(52) U.S. Cl.

CPC ..... *G07C 9/28* (2020.01); *G07C 9/00309* (2013.01); *G07C 9/00571* (2013.01); *G07C 9/257* (2020.01); *G07C 9/27* (2020.01); *G07C 9/26* (2020.01); *G07C 2009/00769* (2013.01)

(58) Field of Classification Search

CPC ..... G07C 9/00111; G07C 9/00087; G07C 9/00103; G07C 9/00309; G07C 9/00571; G07C 2009/00095; G07C 2009/00769; G07C 9/28; G07C 9/27; G07C 9/257

See application file for complete search history.

(56) References Cited

U.S. PATENT DOCUMENTS

| | | | | |
|---|---|---|---|---|
| 9,353,551 | B2 * | 5/2016 | Martinez | H04W 12/06 |
| 2011/0095863 | A1 * | 4/2011 | Laaroussi | G07C 9/00563 340/5.7 |
| 2012/0144204 | A1 * | 6/2012 | Litz | H04L 63/0861 713/186 |
| 2013/0237193 | A1 * | 9/2013 | Dumas | G07C 9/00571 455/414.1 |

(Continued)

*Primary Examiner* — Thomas D Alunkal

(74) *Attorney, Agent, or Firm* — Preston Smirman; Smirman IP Law, PLLC

(57) ABSTRACT

An access control system is described and includes a server, a controller for regulating the accessibility of an entrance, and a mobile device having an application for user to trigger an access authentication process, means for collecting biometric information of the user, and a BLUETOOTH module to establish a BLUETOOTH communication link between the mobile device and the controller. The controller includes a communication module for connecting the controller to the server and mobile device for receiving updates on user access credentials, an access module for activating/deactivating a barrier of entrance, and a microprocessor for verifying the received user access credentials, generating an door execution command, and uploading the entrance status to the server.

4 Claims, 5 Drawing Sheets

(56) References Cited

U.S. PATENT DOCUMENTS

| | | | | |
|---|---|---|---|---|
| 2016/0055694 | A1* | 2/2016 | Saeedi | G07C 9/257 340/5.52 |
| 2016/0070898 | A1* | 3/2016 | Kwok-Suzuki | G06F 21/316 726/7 |
| 2016/0180618 | A1* | 6/2016 | Ho | G07C 9/37 340/5.52 |
| 2017/0053467 | A1* | 2/2017 | Meganck | G07C 9/00563 |
| 2017/0069149 | A1* | 3/2017 | Scheja | G07C 9/215 |

* cited by examiner

MOBILE-BASED ACCESS CONTROL SYSTEM WITH WIRELESS ACCESS CONTROLLER

CROSS-REFERENCE TO RELATED APPLICATION

The instant application claims priority to Malaysian Patent Application Serial No. PI 2018701480 filed Apr. 13, 2018, the entire specification of which is expressly incorporated herein by reference.

FIELD OF THE INVENTION

The invention relates to an entrance access system. More particularly, the invention relates to wireless entrance access systems using mobile devices and methods thereof.

BACKGROUND OF THE INVENTION

Over the years, traditional lock systems or digital lock system have been applied for high security areas or in locker rooms for buildings. Drawbacks were found within these systems whereby the buildings are not perfectly secured. With the advancements of technology, RFID cards were introduced to replace traditional keys. This system requires the users to wear or carry identification badges for building access, which are either inspected by security guards or are read by machines installed at the access doors. Nevertheless, these cards were not effective enough due to the possibility of getting lost, stolen or forgotten.

There are a few patented technologies regarding the aforementioned door access systems. A wireless access control system is disclosed in U.S. Patent Application Publication No. 2013/0237193, and provides guidance on a wireless access control system and includes a remote access device. A plugin device communicates with the remote access device. A lock controls the ability to lock and unlock a door in which the lock is disposed. The lock is in communication with the plug in device. The plug in device determines a distance between the remote access device and the lock and causes the lock to communicate with the remote access device when the remote access device is at a distance less than or equal to a predetermined distance from the lock to enable the lock to be unlocked. Nonetheless, the disclosed invention does not include security features such as password during the unlock operation.

U.S. Pat. No. 9,353,551 discloses a wireless door locking system including a door lock having a locking device, a sensor and a microcontroller. The system also includes a mobile computing device having a display and a mobile application, wherein the mobile computing device is placed proximate to the door lock. The system includes a server in communication with the mobile computing device. The mobile application may generate a code such as a light pattern in response to communication with the server and transmits the light pattern from the display. The controller of the door lock disengages the locking device in response to the sensor receiving the generated code communicated from the mobile computing device and determining that the generated code includes correct data to disengage the locking device of the door lock. However, the drawback of this system is that the accessibility of user is not updateable in real time such that certain users can only grant access at a predetermined time.

Accordingly, there exists a need for new and improved entrance access control systems, and methods for using same, that can overcome the aforementioned deficiencies.

SUMMARY OF THE INVENTION

One objective of the invention is to provide users with an access system comprising a server, a controller for regulating the accessibility of an entrance and a mobile device having an application for user to trigger an access authentication process, means for collecting biometric information of the user and a BLUETOOTH module to establish a BLUETOOTH communication link between the mobile device and the controller.

By BLUETOOTH, as that term is used herein, it is meant to include, without limitation, any wireless technology standard for exchanging data over short distances using short-wavelength UHF radio waves in the ISM band from 14 to 2.485 GHz) from and mobile telecommunication devices, and building personal area networks (PANs).

By "mobile device," as that term is used herein, it is meant to include, without limitation, cellular telephones, satellite telephones, mobile computers, mobile Internet devices, tablets, smartphones, laptops, wearable computers, calculator watches, smartwatches, head-mounted displays, personal digital assistants, enterprise digital assistants, graphing calculators, handheld game consoles, portable media players, calculators, ultra-mobile PCs, digital media players, digital still cameras (DSC), digital video cameras (DVC), digital camcorders, feature phones, pagers, personal navigation devices (PND), smart cards and/or the like.

Preferably, the controller has a communication module for connecting the controller to the server and mobile device for receiving updates on user access credentials, an access module for activating/deactivating a barrier of entrance and a microprocessor for verifying the received user access credentials, generating an door execution command, and uploading the entrance status to the server.

Preferably, upon the controller receiving a BLUETOOTH signal from the mobile device after a successful biometric verification, the controller then performs a second authentication via the microprocessor to verify the user's accessibility based on the updated user access credentials, and followed by triggering the access module to provides access permission for the user based on the outcomes of the authentications, and further uploads the entrance status to the server.

Preferably, the controller further includes a buzzer for indicating the status of the entrance to the user.

Preferably, the communication module is capable of establishing BLUETOOTH, WiFi, IR wireless communication, satellite communication, broadcast radio, microwave radio, ZIGBEE or any combination thereof.

Preferably, the user access credentials includes secret password, date, time, unlock command, user ID, controller pairing code or any combination thereof.

Preferably, the controller further includes an antenna for receiving wireless signal from the server and the mobile device.

One skilled in the art will readily appreciate that the invention is well adapted to carry out the objects and obtain the ends and advantages mentioned, as well as those inherent therein. The embodiments described herein are not intended as limitations on the scope of the invention.

BRIEF DESCRIPTION OF THE DRAWINGS

For the purpose of facilitating an understanding of the invention, there is illustrated in the accompanying drawing the preferred embodiments from an inspection of which when considered in connection with the following description, the invention, its construction and operation and many of its advantages would be readily understood and appreciated.

DETAILED DESCRIPTION OF THE INVENTION

The invention will now be described in greater detail, by way of example, with reference to the drawings.

Figure 1:
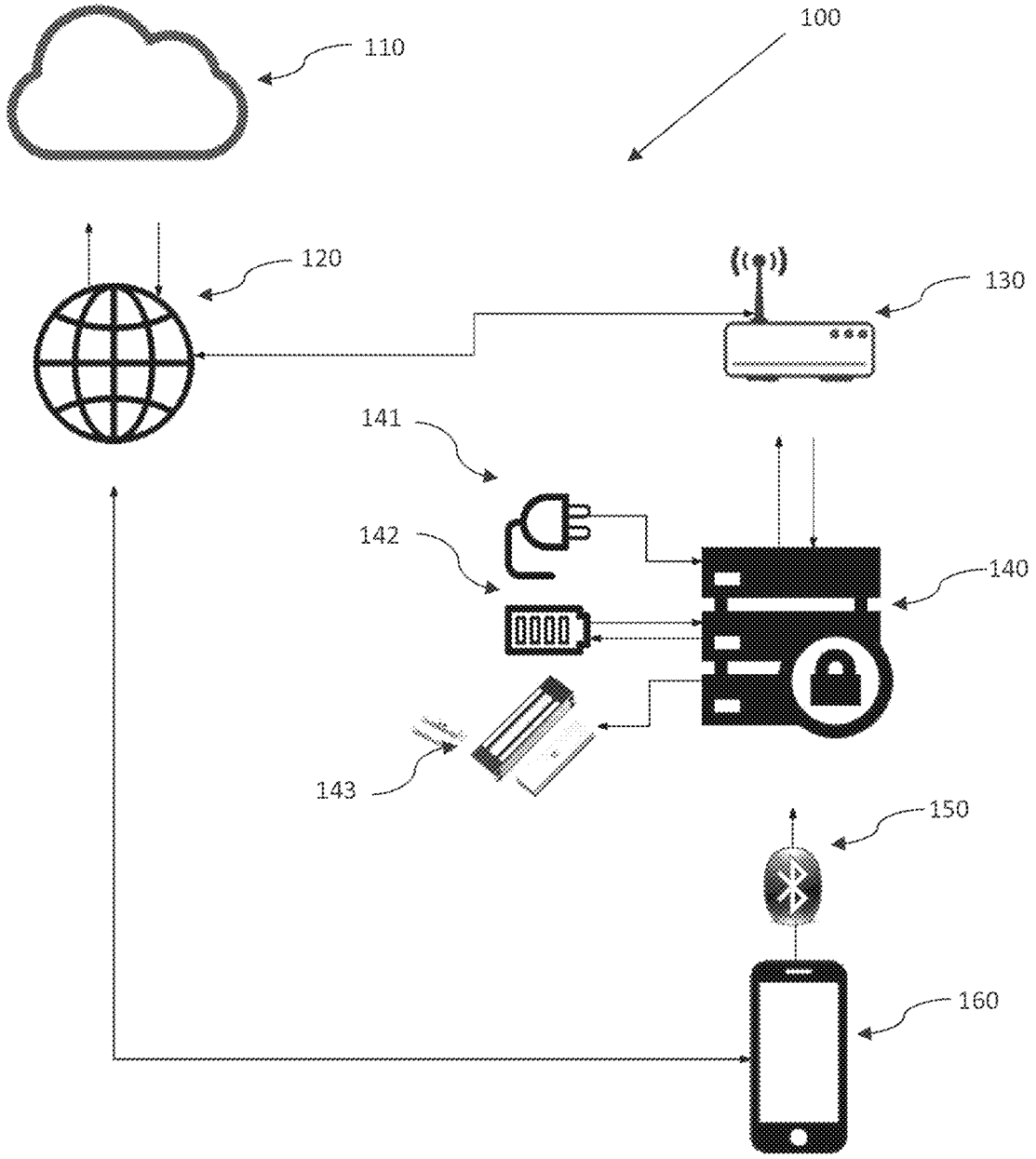
FIG. 1 is a chart illustrating the components of the entrance access system.

FIG. 1 illustrates an embodiment of the mobile-based entrance access system 100. The system 100 includes a cloud-based server 110, at least one mobile device 160 installed with a mobile application, and a controller 140 installed at the entrance, wherein the controller includes means for a power supply 141, a rechargeable backup battery 142 and an electronic lock with magnetic sensors 143. The cloud-based server 110 is setup for different groups of users to register an account. Individual group administrator may login to the system 100 by using a unique login credentials to create and manage the controller 140, user's credentials, and permitted access times. The term "administrator" is referred to a person who modify the grant of access of door entrance in the cloud-based server 110 whereas the term "user" is referred to a person who performs unlocking of entrance using a mobile device 160. The mobile application will require the user to establish a network connection to the cloud-based server 110 for downloading the data from the cloud-based server 110 for authentication purpose. Preferably, the system can be applied in any entrance restricted by physical electronic access control system such as lift or elevator, automatic gate, barrier gate or boom gate or doors.

Figure 2:
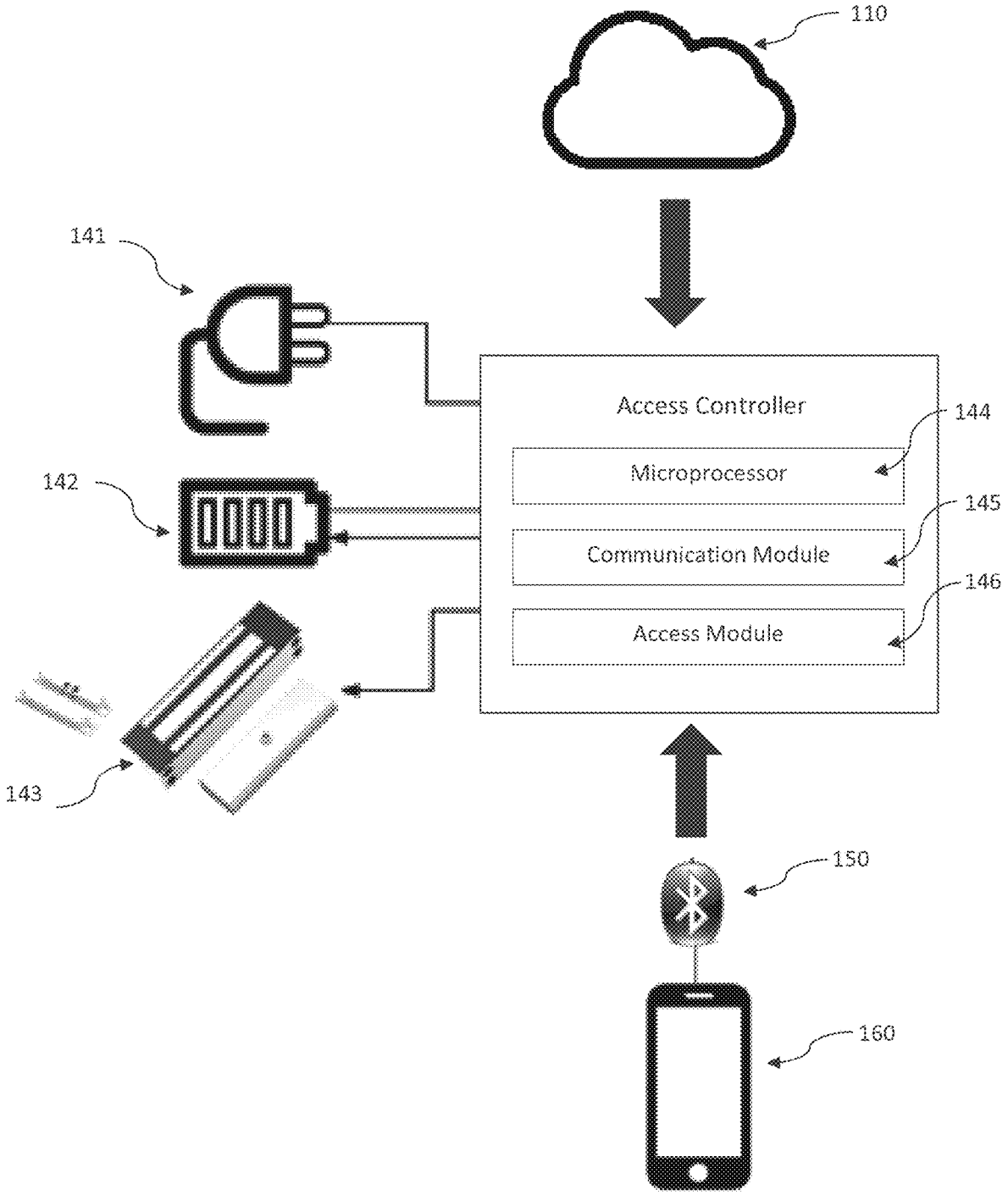
FIG. 2 is a chart illustrating the components of the access controller.

FIG. 2 illustrates a mobile-based access controller 140. The controller includes a communication module 145 for connecting the controller 140 to the server 110 and mobile device 160 for receiving updates on user access credentials, an access module 146 for activating/deactivating a barrier of entrance and a microprocessor 144 for verifying the received user access credentials, generating an door execution command and uploading the entrance status to the server 110. During an operation, the controller receives a BLUETOOTH signal from the mobile device 160 after a successful biometric verification. The controller 140 then performs a second authentication via the microprocessor 144 to verify the user's accessibility based on the updated user access credentials, and followed by triggering the access module 146 to provide access permission for the user based on the outcomes of the authentications, and further uploads the entrance status to the server 110.

Preferably, the mobile device 160 includes a display unit, biometric sensors and a transceiver. The mobile application downloads the user's access credential data from cloud-based server 110, wherein the user's access credential data includes the user's authentication data, user's door entrance accessibility, and accessible date and time. The application further processes the data and reflects the entrances allowed to access on the handheld device's display unit to alert the user. The application installed on the handheld device 160 allows the user to send user ID, date, time and controller 140 pairing code to the controller 140 via BLUETOOTH connection 150. The controller 140 validates the data by internal memory (current date, time and user ID) as second security layer. The controller 140 then sends a signal to unlock the entrance when data is validated. All the entry-exit records will be sent to the cloud-based server 110 by the controller 140 via an Internet connection. Preferably, the controller 140 is connected to a network router or modem 130 for Internet accessibility with the cloud-based server 110.

Figure 3:
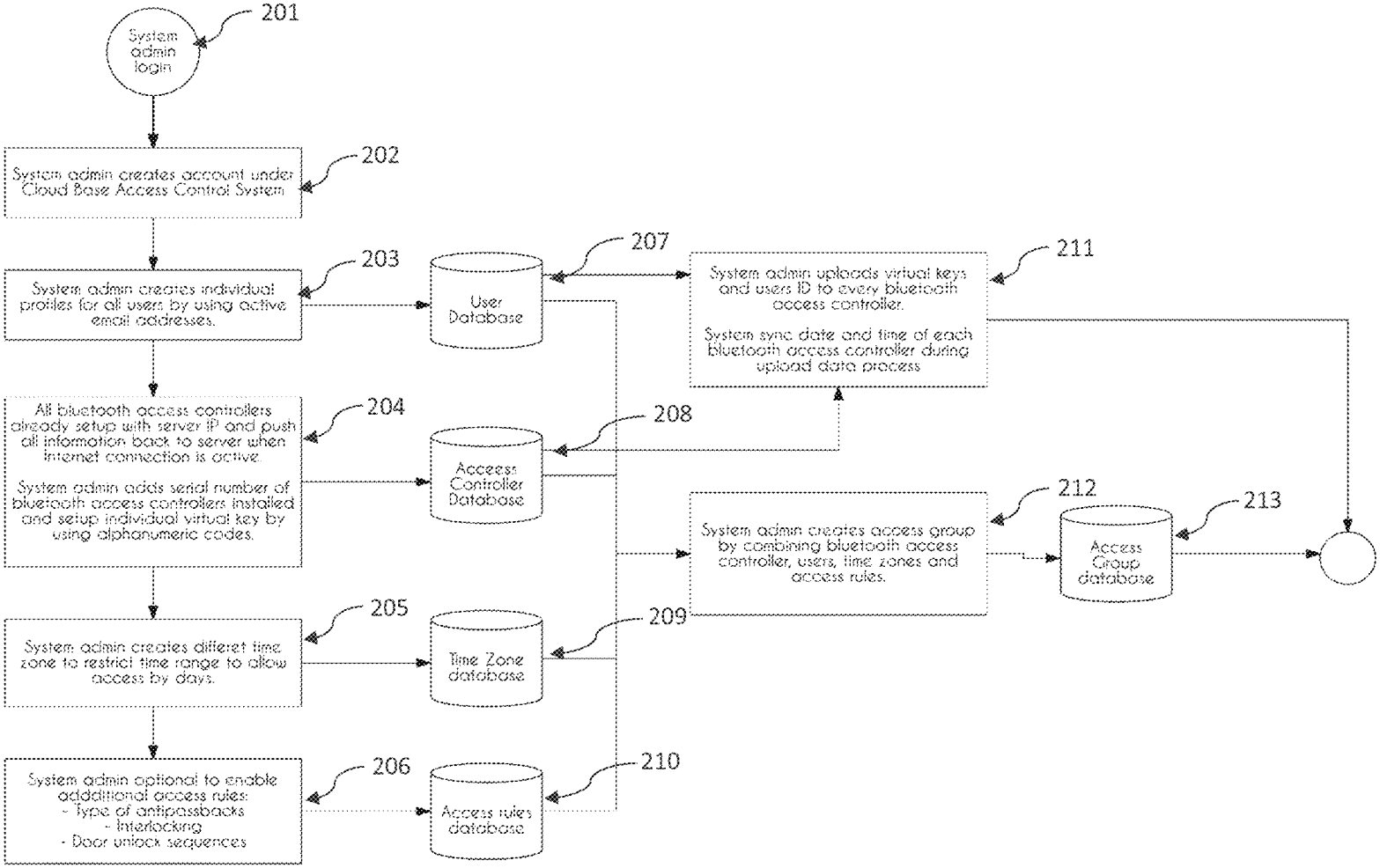
FIG. 3 is a flowchart illustrating the administration of the operation of the system.

The system 100 may operate in different operational embodiments. One of the embodiments discloses the administrator operation as shown in FIG. 3. The system 100 allows the system administrator to access the cloud-based server 110 anytime from anywhere by using the appropriate URL and login credentials. System administrators can handle the system on any OS platform, computing device, etc. Upon successful login 201 to the cloud-based server 110, the system administrator can create a user account 202, individual profiles for all users by using an active email 203, whereby all of the user's information will be stored in a user database 207. Moving on, the system administrator can further setup an individual virtual key 204 for each user, whereby the virtual key will be stored in an access controller database 208. Furthermore, the system administrator may also restrict the time range 205 to allow access by creating a different time zone in the time zone database 209. Additional access rules such as type of anti-pass backs, interlocking and entrance unlock sequences may also be configured within the admin account 206 and all this information will be stored in an access rules database 210. Upon the completion of the administrative setup configuration in the cloud-based server 110, the system administrator will then combine the information such as BLUETOOTH access controller, users, time zone and access rules into a access group database 213.

Figure 4:
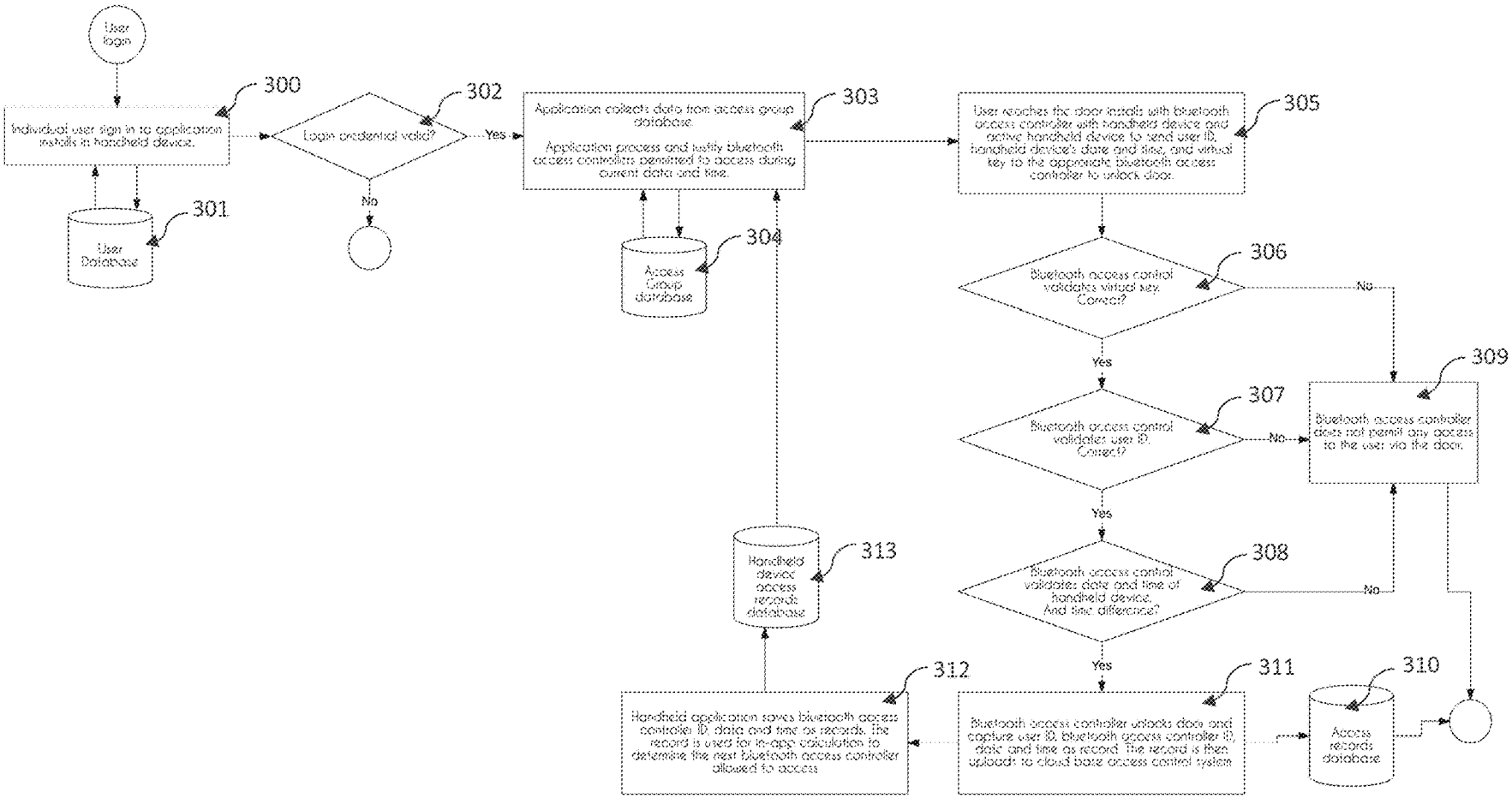
FIG. 4 is a flowchart illustrating the flow automation of the BLUETOOTH access controller for entrance access control.

Another embodiment of the system 100 is illustrated in FIG. 4, whereby the user operation mode of the system is shown. The user operation mode starts with step 300 where a registered user signs in to the application installed in a handheld device 160 in which the application will refer to the user database 301 for validating the user identity 302. Next, in step 303 the application will then collect data from the access group database 304 for further processing and justifying the BLUETOOTH access controller permitted to access during current data and time. Followed by step 305, the user will then reach the entrance installed with the BLUETOOTH access controller with the mobile device and send the user's access credentials such as user ID, mobile device's date and time, and virtual to the appropriate controller 140 for entrance unlocking. The controller 140 will then validate the virtual key 306, user ID 307, and date and time 308 of the mobile device 160 and deny the access 309 of the user if the any one of the credentials is not valid. Moving on, in step 311, upon validation, the controller 140 unlocks the entrance and records the user's access in the access record database 310. On the other hand, the mobile device application will also save the controller's ID, date and time in the mobile device access record database 313 as a record 312 for the use of in-app calculation to determine the next BLUETOOTH access controller allowed to access.

On the other hand, the BLUETOOTH access controller 140 broadcasts its device ID via BLUETOOTH link 150 to the mobile device 160 such that the users are no longer required to activate the application in the mobile device before approaching the BLUETOOTH access controller 140. When a user with the mobile device 160 comes into the broadcasting range, the application captures the device ID and starts to compute the accessibility. The computing process can be referred in step 303 of FIG. 4 where the application will compare the device ID with access group database 304 to justify the accessibility to the BLUETOOTH access control at the current date and time. If the user is permitted to access via this BLUETOOTH access controller 140, the application alerts the users by push notification method. Users can read the on-screen message and tap on screen command buttons to instruct the mobile device 160 to send an unlock command to the BLUETOOTH access controller 140. By using the push notification method in the mobile device 160, the step of signing in to the mobile application to send an unlock entrance command can be neglected. However, the calculation operation is same as step 305 in FIG. 3. In another embodiment where the user is using a wearable device such as a smart watch, fitness tracking bands and smart glasses, the mobile device 160 can sync the information and message to the wearable device so that the users can perform the same operation on the wearable device without using the mobile device.

Figure 5:
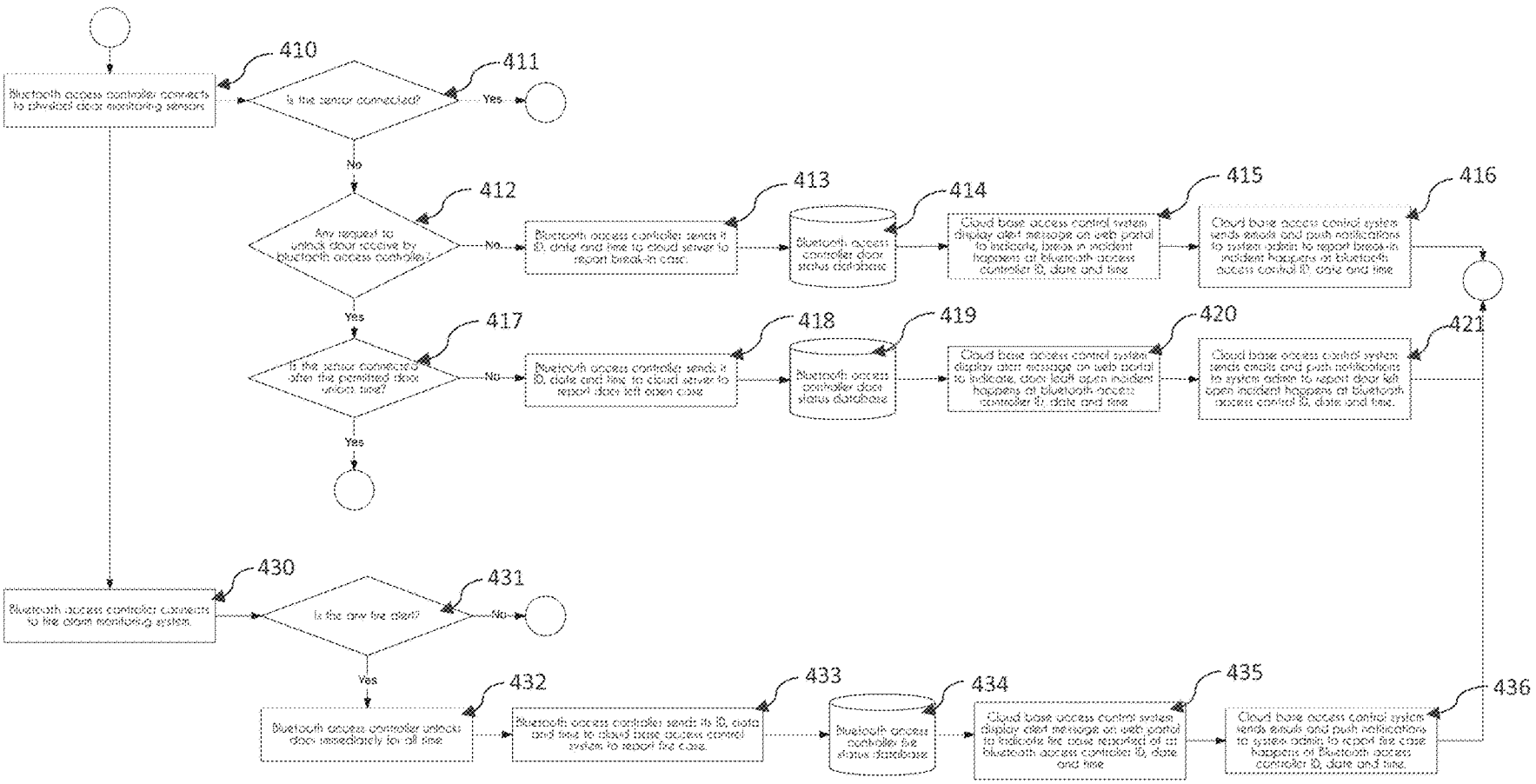
FIG. 5 is a flowchart illustrating the user operation of the system

Furthermore, the BLUETOOTH access controller also includes security features as shown in FIG. 5, wherein the controller is further connecting to a physical entrance monitoring sensor 410. In one of the preferred embodiments, the controller will perform a constant checking on the connection of the entrance sensors 411 and report a break-in case 413 to the server when the entrance is unlocked without authorization 412. The report will be sent to a BLUETOOTH access controller status database 414 for the server to display an alert message 415 on a web portal to indicate the break-in incident. The server will then send emails and push notifications 416 to the system administrator to report the break-in. In the second embodiment, the controller will perform a check on the sensor connection for preventing an entrance left open case 417. The controller will send a report 418 to the server if an entrance left open case is detected to the BLUETOOTH access controller entrance status database 419. The server will then gather the information from the database, display an alert message on the web portal 420 and lastly alert the system administrator 421 by emails or push notifications. In the third embodiment, which involves an emergency case that happened within a building, the controller is further connected to a fire alarm monitoring system 430. When a fire alert is triggered 431, the controller will unlock the entrance 432 immediately for evacuation purposes. The fire case will then be reported by the controller to the server 433 and is stored in the BLUETOOTH access controller fire status database 434. The server will further alert the administrator by displaying an alert message 435 and sending push notifications 436.

On the other hand, the use of second layer of authentication in the controller 140, where the controller 140 performs checks on the user ID, date and time before the entrance access could be granted, minimizes the possibility of hijacking. In case a system administrator restricts the user to access any door, but the user does not update the data in his mobile device 160. However, the changes already applied to all controllers 140, by removing the selected user ID to block access. This stops the user to access even if his application in mobile device grants him access. When it comes to access time control, the user can change the date and time on the mobile device 160. Thus, the controller 140 validates the date and time sent by the application in mobile device 160, to ensure time is synced.

The present disclosure includes as contained in the appended claims, as well as that of the foregoing description. Although this invention has been described in its preferred form with a degree of particularity, it is understood that the present disclosure of the preferred form has been made only by way of example and that numerous changes in the details of construction and the combination and arrangements of parts may be resorted to without departing from the scope of the invention.

What is claimed is:

1. An access control system, comprising:

a server;

a controller for regulating the accessibility of an entrance; and a mobile device having:

an application for a user to trigger an access authentication process;

a biometric sensor for collecting biometric information of the user; and a BLUETOOTH module to establish a BLUETOOTH communication link between the mobile device and the controller;

wherein a successful first access authentication process triggers the application to transmit information relating to user identity, date and time to the controller;

wherein the controller comprises:

a communication module for connecting the controller to the server and mobile device for receiving information from the mobile device;

an access module for activating/deactivating a barrier of entrance; and a microprocessor for performing a second access authentication process based on the received information, generating an door execution command, and uploading the entrance status to the server;

wherein, upon the controller receiving the information from the mobile device after the first successful access authentication process, the controller then performs the second access authentication process via the microprocessor to verify the user's accessibility by validating the received date and time, and followed by triggering the access module to provide access permission for the user based on the outcomes of the authentications, and further uploads the entrance status to the server.

2. The system as claimed in claim 1, wherein the controller further comprises a buzzer for indicating the status of entrance to the user.

3. The system as claimed in claim 1, wherein the communication module is capable of establishing BLUETOOTH, WiFi, IR wireless communication, satellite communication, broadcast radio, microwave radio, ZIGBEE or any combination thereof.

4. The system as claimed in claim 1, wherein the controller further comprises an antenna for receiving a wireless signal from the server and mobile device.

* * * * *